US008401451B2

(12) United States Patent
Nakajima et al.

(10) Patent No.: US 8,401,451 B2
(45) Date of Patent: Mar. 19, 2013

(54) HEATING FIXING ROLLER AND PROCESS FOR PRODUCING THE HEATING FIXING ROLLER

(75) Inventors: Shingo Nakajima, Osaka (JP); Jun Sugawara, Osaka (JP); Akira Mizoguchi, Osaka (JP); Yusuke Uchiba, Sennan-gun (JP); Yoshimasa Suzuki, Sennan-gun (JP)

(73) Assignees: Sumitomo Electric Industries, Ltd., Osaka-shi, Osaka (JP); Sumitomo Electric Fine Polymer, Inc., Osaka (JP)

( * ) Notice: Subject to any disclaimer, the term of this patent is extended or adjusted under 35 U.S.C. 154(b) by 285 days.

(21) Appl. No.: 12/995,745

(22) PCT Filed: Mar. 10, 2009

(86) PCT No.: PCT/JP2009/054580
§ 371 (c)(1),
(2), (4) Date: Dec. 2, 2010

(87) PCT Pub. No.: WO2009/150877
PCT Pub. Date: Dec. 17, 2009

(65) Prior Publication Data

US 2011/0142509 A1 Jun. 16, 2011

(30) Foreign Application Priority Data

Jun. 9, 2008 (JP) ..... 2008-150938

(51) Int. Cl.
*G03G 15/01* (2006.01)

(52) U.S. Cl. ..... 399/333
(58) Field of Classification Search ..... 399/333
See application file for complete search history.

(56) References Cited

U.S. PATENT DOCUMENTS 5,468,584 A * 11/1995 Go et al. ..... 430/65
5,714,248 A * 2/1998 Lewis ..... 428/325

FOREIGN PATENT DOCUMENTS

| | | |
|---|---|---|
| JP | 06-092636 | 4/1994 |
| JP | 07-076025 | 3/1995 |
| JP | 08-220907 | 8/1996 |
| JP | 08-328408 | 12/1996 |
| JP | 10-213948 | 8/1998 |
| JP | 10-293487 | 11/1998 |
| JP | 2000-147928 | 5/2000 |
| JP | 2001-125404 | 5/2001 |
| JP | 2003-082231 | 3/2003 |
| JP | 2004-086202 | 3/2004 |
| JP | 2007-253425 | 10/2007 |

* cited by examiner

*Primary Examiner* — David Gray
*Assistant Examiner* — G. M. Hyder
(74) *Attorney, Agent, or Firm* — Drinker Biddle & Reath LLP

(57) ABSTRACT

Provided is a heating fixing roller which includes a tubular base member and a fluororesin layer provided on an outer circumferential surface of the base member directly or through an adhesive layer, the heating fixing roller being characterized in that the fluororesin layer contains phosphorus-doped tin oxide. The heating fixing roller has a surface resistance capable of stably and effectively preventing the occurrence of electrostatic offsets, and also has an excellent releasing property. Also provided is a process for producing the heating fixing roller, characterized by including the steps of applying a fluororesin dispersion containing an aqueous dispersion of phosphorus-doped tin oxide onto a tubular base member or an adhesive layer disposed on an outer circumferential surface of the tubular base member, and then sintering the fluororesin.

7 Claims, 1 Drawing Sheet

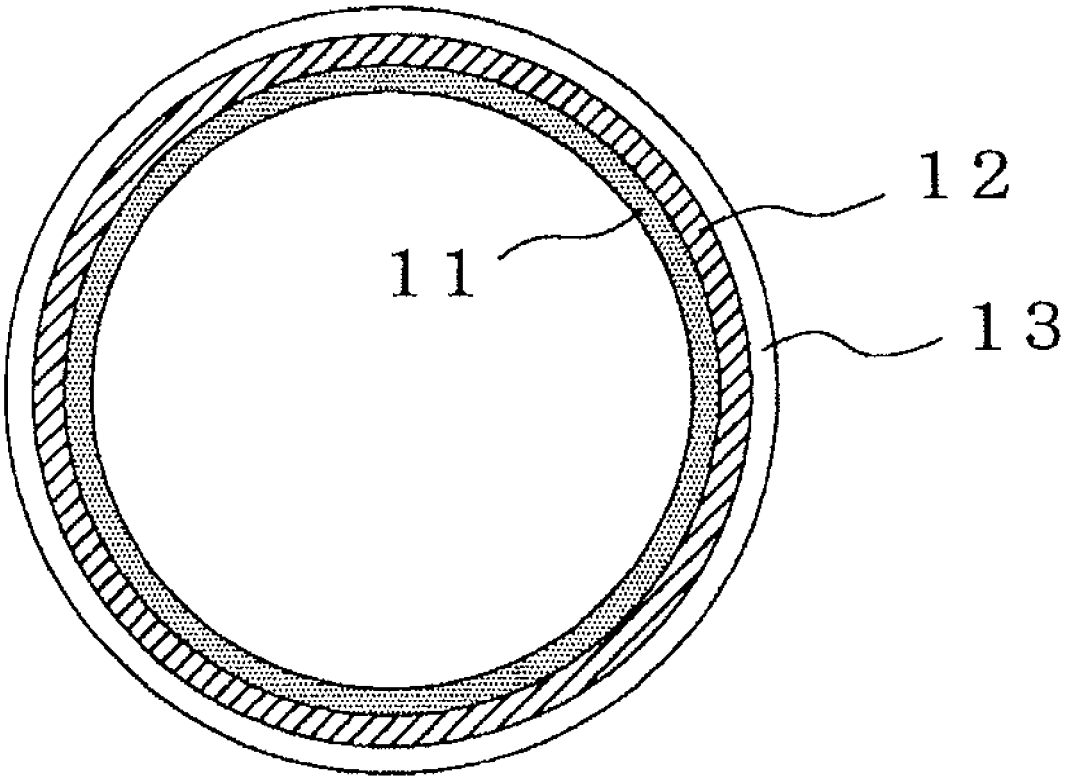
12
11
13

HEATING FIXING ROLLER AND PROCESS FOR PRODUCING THE HEATING FIXING ROLLER

TECHNICAL FIELD

The present invention relates to a heating fixing roller which includes a tubular base member and a fluororesin layer provided on an outer circumferential surface of the base member and which is used to fix a toner image formed on copy paper in a copying machine or a printer, and a process for producing the heating fixing roller.

BACKGROUND ART

In copying machines and laser beam printers, a method has been widely employed in which copy paper on which a toner image is formed is passed between a heating fixing roller provided with a heating source inside and a pressure roller, whereby unfixed toner is melted by heating and the toner image is fixed onto the paper. As the heating fixing roller, a roller which includes a base member composed of a metal tube or a heat-resistant plastic tube, such as a polyimide tube, and a fluororesin layer (release layer) for preventing adhesion of molten toner, the fluororesin layer being provided on an outer circumferential surface of the base member, is widely used.

In recent years, with the increase in copying speed, scattering of a toner image on copy paper due to the occurrence of static electricity, and occurrence of electrostatic offsets have become more of a problem. The electrostatic offsets are divided into two types: a total surface offset and a peeling offset. The total surface offset easily occurs when the surface resistance of the release layer is low, while the peeling offset easily occurs when the surface resistance is high. In order to suppress both types of offsets, the acceptable range of surface resistance is required to be very narrow. Therefore, in order to prevent the problem described above, the surface resistance of the fluororesin layer (release layer) is required to be precisely controlled in the heating fixing roller.

In order to decrease the surface resistance of the heating fixing roller, a method has been conceived in which a conductive material, such as carbon black, metal powder, or graphite, is added to the release layer (Patent Document 1). However, when metal powder is used, because of reaction with water in a dispersion (coating material) for forming the fluororesin layer (release layer), oxidation due to high-temperature firing during formation of the fluororesin layer (release layer), or the like, physical properties, such as a releasing property of the fluororesin, are easily degraded, which is a problem. On the other hand, in the case of carbon black or graphite, the dispersion state easily varies and aggregation (percolation) easily occurs. Therefore, it is difficult to stably obtain the intended surface resistance, thus making it difficult to satisfy recent requirements.

As a method of preventing aggregation of carbon black or graphite, use of a semiconductive inorganic substance as an electric potential stabilizer together with carbon black or graphite is known. Patent Document 1 discloses combined use of about 0.3% to 8% by weight of a good conductive substance (conductive material), such as carbon black or graphite, and 5% to 50% by weight of a semiconductive inorganic substance, such as titanium oxide, iron oxide, aluminum hydroxide, talc, barium titanate, antimony oxide, silica, or calcium carbonate, and by the combined use, aggregation of carbon black, graphite, or the like can be prevented to a certain degree (Patent Document 1, paragraph 0024).

Patent Document 1: Japanese Unexamined Patent Application Publication No. 2001-125404

DISCLOSURE OF INVENTION

Problems to be Solved by the Invention

However, in order to prevent aggregation of carbon black, graphite, or the like by using a semiconductive inorganic substance together therewith, it is necessary to add the semiconductive inorganic substance in the amount described above, i.e., about 5% to 50% by weight. As a result, the mixing amount of the semiconductive inorganic substance in the fluororesin layer (release layer) increases, thus decreasing the releasing property of the fluororesin, which is a problem.

It is an object of the present invention to provide a heating fixing roller which has a surface resistance within the acceptable control range, that is, a surface resistance capable of stably and effectively preventing the occurrence of electrostatic offsets, and which also has an excellent releasing property, and a process for producing the heating fixing roller.

Means for Solving the Problems

As a result of diligent research to solve the problems, the present inventors have found that, by using an aqueous dispersion of phosphorus-doped tin oxide as a conductive material to be added to the fluororesin layer (release layer), stable surface resistance (charging characteristics) can be easily obtained, and that since a large amount of an inorganic semiconductive substance is not required to be used together therewith, a heating fixing roller having an excellent releasing property can be produced. Thus, the present invention has been completed.

That is, the present invention provides, as Claim 1, a heating fixing roller including a tubular base member and a fluororesin layer provided on an outer circumferential surface of the base member directly or through an adhesive layer, the heating fixing roller being characterized in that the fluororesin layer contains phosphorus-doped tin oxide.

The heating fixing roller includes a tubular base member and a fluororesin layer provided on an outer circumferential surface of the base member directly or through an adhesive layer as in a heating fixing roller which has been conventionally used in a copying machine or a printer, but is characterized in that the fluororesin layer contains phosphorus-doped tin oxide as a conductive material.

Since phosphorus-doped tin oxide has good dispersibility and has a lower degree of aggregation than carbon black or graphite, it is easy to obtain stable surface resistance (charging characteristics) of the roller. Consequently, the heating fixing roller of the present invention can have a surface resistance within a very narrow acceptable control range that has been required in recent years. As a result, it is possible to suppress both a total surface offset and a peeling offset.

Furthermore, since a large amount of an inorganic semiconductive substance or the like is not required to prevent aggregation, the content of the inorganic semiconductive substance can be reduced, and it is possible to suppress a decrease in the releasing property due to addition of the inorganic semiconductive substance. Consequently, in the heating fixing roller, occurrence of electrostatic offsets is suppressed, high-speed and excellent copying can be achieved, and excellent mechanical characteristics, such as wear resistance, can be exhibited.

Although antimony-doped tin oxide or the like is also known (Japanese Unexamined Patent Application Publication No. 2007-253425), it has environmental problems. However, phosphorus-doped tin oxide does not have environmental problems, and can have better conductive properties than those in the case where pure tin oxide is used as the conductive material.

Examples of the fluororesin constituting the fluororesin layer include polytetrafluoroethylene (PTFE), tetrafluoroethylene-perfluoroalkylvinyl ether copolymers (PFA), tetrafluoroethylene-hexafluoropropylene copolymers (FEP), and ethylene-tetrafluoroethylene copolymers (ETFE). These can be used alone or in a mixture thereof.

The fluororesin layer can be formed by a method in which a varnish containing a fluororesin or a fluororesin dispersion is applied onto a base member (polyimide tube) produced as described above or an adhesive layer, which will be described below, formed on the base member, followed by sintering. The present invention is characterized in that the fluororesin layer contains phosphorus-doped tin oxide, and the phosphorus-doped tin oxide can be incorporated by adding an aqueous dispersion (aqueous sol) of phosphorus-doped tin oxide to a varnish containing a fluororesin or a fluororesin dispersion.

An invention according to Claim 2 relates to the heating fixing roller according to Claim 1, characterized in that the surface electrical resistivity of the fluororesin layer is in a range of $1\times10^{9}$ to $1\times10^{16}\Omega/\square$. The surface electrical resistivity of the fluororesin layer adjusted by addition of phosphorus-doped tin oxide is preferably in the range described above. By setting the surface electrical resistivity within this range, it is possible to prevent scattering of a toner image on copy paper due to the occurrence of static electricity, and it is possible to suppress both a total surface offset and a peeling offset. The surface electrical resistivity is more preferably in a range of $1\times10^{10}$ to $1\times10^{16}\Omega/\square$, and still more preferably in a range of $1\times10^{10}$ to $1\times10^{15}\Omega/\square$. In the case where a conductor, such as carbon black or graphite, is used, it is difficult to adjust the surface electrical resistivity to such a narrow range. However, by using phosphorus-doped tin oxide as a conductor, precise adjustment to this range is facilitated.

The phosphorus-doped tin oxide is tin oxide containing phosphorus, and for example, a commercially available one, such as trade name CELNAX CX-S301H (manufactured by Nissan Chemical Industries, Ltd.), can be used. The aqueous dispersion (aqueous sol) of phosphorus-doped tin oxide can be produced, for example, by a sol-gel method. The aqueous dispersion (aqueous sol) produced by the sol-gel method has excellent dispersibility, and thus is preferably used. The content of tin oxide in the aqueous dispersion of phosphorus-doped tin oxide is usually about 30% although not particularly limited thereto. The particle size of tin oxide is not particularly limited, but is usually 5 to 20 nm.

An invention according to Claim 3 relates to the heating fixing roller according to Claim 1 or 2, characterized in that the content of the phosphorus-doped tin oxide in the fluororesin layer is 3% to 50% by weight. The content of the phosphorus-doped tin oxide is preferably in the range that allows the surface electrical resistivity of the fluororesin layer to be in the range described above. Although the preferable range varies depending on the amount of phosphorus doped in tin oxide, or the like, in the case where a commercially available phosphorus-doped tin oxide, such as CELNAX CX-S301H, is used, the content of the phosphorus-doped tin oxide in the fluororesin layer is preferably 3% to 50% by weight, more preferably 4% to 30% by weight, and still more preferably 5% to 15% by weight.

An invention according to Claim 4 relates to the heating fixing roller according to any one of Claims 1 to 3, characterized in that the thickness of the fluororesin layer is in a range of 5 to 20 μm. When the thickness of the fluororesin layer is less than 5 μm, a problem easily occurs in terms of durability of the roller. On the other hand, when the thickness exceeds 20 μm, thermal conductivity of the polyimide tube roller as a whole degrades, and a problem easily occurs in terms of a fixing property (that is, normal fixing is not easily performed).

Examples of the tubular base member constituting the heating fixing roller of the present invention include a base member composed of a tube, such as a metal tube or a heat-resistant plastic tube; and a base member in which an elastic layer, e.g., a rubber layer, is provided on an outer circumferential surface of a tube, such as a metal tube or a heat-resistant plastic tube. An invention according to Claim 5 relates to the heating fixing roller according to any one of Claims 1 to 4, characterized in that the tubular base member is a base member composed of a metal tube or a heat-resistant plastic tube, or a base member composed of a metal tube or a heat-resistant plastic tube coated with an elastic layer.

As the metal tube, for example, a SUS tube may be used. Examples of the heat-resistant plastic tube include a polyimide tube. Among the tubes, a polyimide tube is preferable because it excels in heat resistance, dimensional stability, chemical properties, and mechanical properties. An invention according to Claim 6 relates to the heating fixing roller according to any one of Claims 1 to 4, characterized in that the tubular base member is a base member composed of a polyimide tube or a base member composed of a polyimide tube coated with an elastic layer.

The polyimide tube is a tubular article composed of a polyimide resin composition. For example, a polyimide tube manufactured by a manufacturing method described in Japanese Unexamined Patent Application Publication No. 7-76025 or the like may be used. The thickness or the like of the polyimide tube can be appropriately selected according to the desired mechanical strength, use, and the like, but is preferably about 20 to 500 μm, when used in a normal copying machine, in order to achieve heat resistance, dimensional stability, chemical properties, and mechanical properties.

There may be a case where a layer other than the elastic layer is provided on the tube. For example, in the case of a base member in which a tube is coated with an elastic layer, a bonding agent layer may be provided between the elastic layer and a metal tube or a heat-resistant plastic tube.

The fluororesin layer may be formed directly on the base member. Alternatively, an adhesive layer may be provided as an intermediate layer in order to improve adhesiveness between the base member and the fluororesin layer, and the fluororesin layer may be formed on the adhesive layer. In view of heat resistance, the adhesive layer is preferably composed of a heat-resistant resin. As the resin constituting the adhesive layer, for example, a mixture of a fluororesin and a polyamide-imide resin, a mixture of a fluororesin and a polyether sulfone resin, or the like is preferably used, although not particularly limited. The thickness of the adhesive layer is usually 0.1 to 20 μm, and preferably about 1 to 10 μm.

The heating fixing roller of the present invention can be produced by a process including the steps of applying a fluororesin dispersion containing an aqueous dispersion of phosphorus-doped tin oxide onto a tubular base member or an adhesive layer disposed on an outer circumferential surface of the tubular base member, and then sintering the fluororesin in the dispersion. The present invention also provides, as Claim 7, this production process.

The tubular base member and the adhesive layer can be produced by known methods, such as the method described in Japanese Unexamined Patent Application Publication No.

7-76025. Application of the fluororesin dispersion can be performed, for example, by a method in which a tubular base member or a tubular base member having an adhesive layer provided on an outer circumferential surface thereof is immersed in a fluororesin dispersion and then removed from the dispersion. As the fluororesin dispersion, a dispersion prepared by dispersing fluororesin particles in a dispersion medium obtained by mixing a small amount of an organic solvent in water can be used.

Advantages

A heating fixing roller of the present invention has a surface resistance that can stably prevent the occurrence of electrostatic offsets effectively, and excels in a releasing property and wear resistance. Furthermore, the heating fixing roller of the present invention can be easily produced by a production process of the present invention, in which problems, such as degradation in a releasing property and wear resistance, do not occur.

BRIEF DESCRIPTION OF DRAWINGS

FIGURE is a cross-sectional view showing an example of a heating fixing roller of the present invention.

REFERENCE NUMERALS

11 base member
12 adhesive layer
13 fluororesin layer

BEST MODE FOR CARRYING OUT THE INVENTION

A best mode for carrying out the present invention will be described below. However, it is to be understood that the scope of the present invention is not limited to the best mode.

FIGURE is a cross-sectional view showing an example of a heating fixing roller of the present invention in which a fluororesin layer 13 is formed through an adhesive layer 12 on an outer circumferential surface of a base member 11 composed of a polyimide resin (polyimide tube). Furthermore, as an intermediate layer, a resin layer other than the adhesive layer, or a rubber layer may be additionally disposed.

As the polyimide resin constituting the base member 11, a known thermoplastic polyimide resin or thermosetting polyimide resin may be used. For example, a polyimide resin can be obtained by reacting an aromatic tetracarboxylic dianhydride with an aromatic diamine component in an organic polar solvent. Examples of the aromatic tetracarboxylic acid include pyromellitic dianhydride, 3,3',4,4'-biphenyltetracarboxylic dianhydride, 3,3',4,4'-benzophenonetetracarboxylic dianhydride, 2,3,4,4'-biphenyltetracarboxylic dianhydride, 2,3,6,7-naphthalenetetracarboxylic dianhydride, 1,2,5,6-naphthalenetetracarboxylic dianhydride, and 2,2-bis(3,4-dicarboxyphenyl)ether dianhydride. Alternatively, tetracarboxylic esters thereof and mixtures of the tetracarboxylic acids described above may be used. Meanwhile, examples of the aromatic diamine component include para-phenylenediamine, meta-phenylenediamine, 4,4'-diaminodiphenyl ether, 4,4'-diaminophenylmethane, benzidine, 3,3'-diaminodiphenylmethane, 3,3'-dimethoxybenzidine, 4,4'-diaminodiphenylpropane, and 2,2-bis[4-(4-aminophenoxy)phenyl]propane.

In the case where the polyimide resin is a thermosetting polyimide resin, first, a polyimide precursor (also referred to as "polyamide acid" or "polyamic acid") is synthesized. An organic solvent solution of the polyimide precursor (polyimide varnish) is applied to an outer surface or an inner surface of a cylindrical core, and after drying, heating is performed to a maximum temperature of about 350° C. to 450° C. The polyamide acid is made to undergo dehydration ring closure by heating to form a polyimide, which is then cured. A tubular base member (polyimide tube) can be thereby obtained.

Examples of the organic polar solvent to be used include dimethylacetamide, dimethylformamide, N-methyl-2-pyrrolidone, phenol, and O-, M-, and P-cresols. A hydrocarbon, such as xylene, hexane, or toluene, may be mixed with these organic polar solvents. Furthermore, a thermal conduction improving agent, such as boron nitride, carbon powder, or metal powder, may be incorporated into the polyimide precursor solution.

As the adhesive layer 12, a resin layer composed of the material described above can be used. Furthermore, when a conductive filler is incorporated into the adhesive layer 12, the effect of shielding the inner surface of a fixing belt against triboelectric charging and the antistatic effect for the outer surface can be enhanced, and thus offsets can be more effectively prevented, which is preferable. As the conductive filler for the adhesive layer, the same conductive filler as that used for the outer layer can be used. The amount of the conductive filler to be added is usually 0.5% to 10% by weight, and preferably about 1% to 5% by weight.

The fluororesin layer 13 is composed of the fluororesin exemplified above and contains phosphorus-doped tin oxide. The fluororesin layer 13 may be further incorporated with conductive carbon black, such as Ketjenblack; a conductive filler, such as metal powder, e.g., aluminum; and a semiconductive inorganic substance, such as titanium oxide, iron oxide, aluminum hydroxide, talc, barium titanate, antimony oxide, silica, or calcium carbonate. However, in the present invention, the amount of addition of a semiconductive inorganic substance can be decreased, and as a result, the problem of a decrease in the releasing property can be prevented.

In the case where the heating fixing roller has a rough surface, a so-called white spots phenomenon, in which unfixed toner falls off from copy paper, thus degrading image quality, easily occurs. As a result, a problem, such as degradation in picture image definition or degradation in image quality, easily occurs. Accordingly, the surface roughness of the fluororesin layer 13 is preferably small, and specifically, preferably 3.5 μm or less in terms of (Rz). Consequently, as the phosphorus-doped tin oxide and the filler (an inorganic semiconductive substance, a good conductive substance, or the like) to be incorporated into the fluororesin layer 13, those having an average particle size of 3 μm or less are preferably used.

EXAMPLES

Examples 1 to 8 and Comparative Examples 1 to 4

As a polyimide precursor varnish, which was a raw material for a base member, a varnish prepared by dissolving "U-Varnish S-301" (specific gravity 1.446, manufactured by Ube Industries, Ltd.) in a solvent (N-methylpyrrolidone) at a concentration of 18% (hereinafter abbreviated as "U varnish S") was used.

A nozzle (discharge port) located at a feed portion of a dispenser was brought into contact with an outer surface of a core composed of aluminum cylinder having an outer diameter of 20 mmϕ, the outer surface of which was coated with ceramic. While rotating the core and moving the nozzle in the rotation axis direction of the core at a constant rate, the U varnish S was constantly fed from the nozzle at the feed portion of the dispenser to thereby apply the polyimide precursor varnish onto the outer surface of the core. As the nozzle at the feed portion of the dispenser, a tube made of PTFE with an inner diameter of 2 mm and an outer diameter of 4 mm was used. The nozzle was moved from a position 20 mm away from the right end of the core (at the time of start of feeding) to a position 20 mm away from the left end of the core (at the time of stop of feeding). After application, while rotating the core, heating was performed stepwise to 400° C., followed by cooling and solidification. Thereby, a tubular body including a base member composed of a polyimide resin was obtained. The base member had a thickness of 80 μm, an outer diameter of 24.2 mm, and a length of 233 mm.

The tubular body thus obtained was coated by immersion in a primer liquid for fluororesin (855-040 CONDUCTIVE PRIMER BLACK manufactured by E.I. du Pont de Nemours and Company). Then, heating was performed at a temperature of 200° C. for 30 minutes to form an adhesive layer with a thickness of 4 μm. The tubular body provided with the adhesive layer was immersed in a fluororesin dispersion, which was obtained as described below, and then removed from the dispersion, and the fluororesin was sintered to form a fluororesin layer.

[Fluororesin Dispersion]

An aqueous sol of phosphorus-doped tin oxide (manufactured by Nissan Chemical Industries, Ltd., CELNAX CX-S301H) was added to a fluororesin (PTFE: manufactured by DuPont Fluorochemical Company, EMX-62-1) at the ratio shown in Table I or II, and as necessary, a filler (carbon black: LION PASTE 310A manufactured by Lion Corporation, or titanium oxide: manufactured by Tayca Corporation, TITANIX JR-600A) was added at the ratio shown in Table I or II, followed by mixing, to obtain each fluororesin dispersion. As comparative examples, fluororesin dispersions in which pure tin oxide, not doped with phosphorus, was added instead of an aqueous sol of phosphorus-doped tin oxide (Comparative Examples 3 and 4), and fluororesin dispersions in which an aqueous sol of phosphorus-doped tin oxide was not added (Comparative Examples 1 and 2) were also obtained.

With respect to the resulting tubular bodies each having a fluororesin layer on the surface thereof, surface electrical resistivity and a variation thereof were measured by the methods described below, and a fixing performance test and an offset test were performed. The results thereof are shown in Tables I and II.

(1) Measurement of Surface Electrical Resistivity:

Measurement was performed using an ultra-high resistance/microammeter (R8340A manufactured by Advantest Corporation) and a ring double electrode as a probe, under an applied voltage of 50 V.

(2) Measurement of Variation of Surface Electrical Resistivity

Surface electrical resistivity was measured on 10 samples, and a difference between the maximum value and the minimum value was defined as a variation.

(3) Fixing Performance Test

The tubular body described above (hereinafter referred to as the "tubular body") was fixed on an aluminum plate. Next, the tubular body was coated with toner and heating was performed until the temperature of the sample reached 150° C. Then, paper was pressed and rubbed against the toner five times, and the paper was removed. It was checked whether or not the toner was transferred to the paper, and evaluation was performed on the basis of the following criteria:

⊙: The toner is completely transferred to the paper.

○: Most of the toner is transferred to the paper.

x: A large amount of the toner remains on the tubular body.

(4) Offset Test

The tubular body was built into a fixing unit, and occurrence or non-occurrence of offsets was evaluated on the basis of the following criteria:

○: No offsets occur.

x: Offsets occur.

TABLE I

| | | Example 1 | Example 2 | Example 3 | Example 4 | Example 5 | Example 6 |
|---|---|---|---|---|---|---|---|
| Thickness of fluororesin layer μm | | 10 | 10 | 10 | 10 | 10 | 10 |
| Phosphorus-doped tin oxide | Type | CELNAX CX-S301H | | | | | |
| | Addition amount wt % | 5 | 7 | 8 | 9 | 12 | 3 |
| Pure tin oxide addition amount wt % | | — | — | — | — | — | — |
| Carbon black addition amount wt % | | — | — | — | — | — | 0.2 |
| Titanium oxide addition amount wt % | | — | — | — | — | — | — |
| Surface electrical resistivity Ω/□ | | $1.2 \times 10^{14}$ | $1.0 \times 10^{14}$ | $8.2 \times 10^{13}$ | $5.1 \times 10^{13}$ | $2.0 \times 10^{13}$ | $1.0 \times 10^{12}$ |
| Variation | | ±one order of magnitude | ±one order of magnitude | ±one order of magnitude | ±one order of magnitude | ±one order of magnitude | ±one order of magnitude |
| Fixing performance | | ○ | ⊙ | ⊙ | ⊙ | ○ | ○ |
| Offset test | | ○ | ○ | ○ | ○ | ○ | ○ |

TABLE II

| | | Example 7 | Example 8 | Comparative Example 1 | Comparative Example 2 | Comparative Example 3 | Comparative Example 4 |
|---|---|---|---|---|---|---|---|
| Thickness of fluororesin layer μm | | 10 | 10 | 10 | 10 | 10 | 10 |
| Phosphorus-doped tin oxide | Type | CELNAX | | — | — | — | — |
| | Addition | CX-S301H | | | | | |
| | amount wt % | 12 | 20 | — | — | — | — |
| Pure tin oxide addition amount wt % | | — | — | — | — | 10 | 25 |
| Carbon black addition amount wt % | | — | — | 0.4 | 0.4 | — | 0.2 |
| Titanium oxide addition amount wt% | | 4 | 4 | 14 | 4 | — | — |
| Surface electrical resistivity Ω/□ | | $2.0 \times 10^{13}$ | $1.0 \times 10^{12}$ | $1.0 \times 10^{12}$ | $1.0 \times 10^{13}$ | $2.0 \times 10^{15}$ | $3.0 \times 10^{13}$ |
| Variation | | ±one order of magnitude | ±one order of magnitude | ±one order of magnitude | ±two orders of magnitude | ±one order of magnitude | ±one order of magnitude |
| Fixing performance | | ○ | ○ | ○ | ○ | ○ | ○ |
| Offset test | | ○ | ○ | X | ○ | X | X |

In Examples 1 to 8 in which phosphorus-doped tin oxide is added to the fluororesin layer, proper surface resistance is obtained, and the variation in surface electrical resistivity is small. It is shown that excellent fixing performance is obtained, and electrostatic offsets can be stably suppressed.

On the other hand, in Comparative Example 1 in which carbon black and a semiconductive filler (titanium oxide) are added instead of tin oxide, and the filler addition amount is large, the releasing property is degraded, and electrostatic offsets occur. In Comparative Example 2 in which carbon black and a semiconductive filler (titanium oxide) are added instead of tin oxide, but the filler addition amount is small, it is shown that, although occurrence of electrostatic offsets is suppressed, the variation in surface electrical resistivity is large, and the surface electrical resistivity that can prevent electrostatic offsets cannot be obtained stably. In Comparative Example 3 in which pure tin oxide is used instead of phosphorus-doped tin oxide, it is not possible to obtain a proper surface electrical resistivity, and electrostatic offsets occur. Furthermore, in Comparative Example 4 in which pure tin oxide is used instead of phosphorus-doped tin oxide, and the amount of pure tin oxide is increased, the releasing property is degraded, and electrostatic offsets occur.

The invention claimed is:

1. A heating fixing roller comprising a tubular base member and a fluororesin layer provided on an outer circumferential surface of the base member directly or through an adhesive layer, wherein the fluororesin layer contains phosphorus-doped tin oxide.

2. The heating fixing roller according to claim 1, wherein the surface electrical resistivity of the fluororesin layer is in a range of $1\times10^{9}$ to $1\times10^{16}$Ω/□.

3. The heating fixing roller according to claim 1, wherein the content of the phosphorus-doped tin oxide in the fluororesin layer is 3% to 50% by weight.

4. The heating fixing roller according to claim 1, wherein the thickness of the fluororesin layer is in a range of 5 to 20 μm.

5. The heating fixing roller according to claim 1, wherein the tubular base member is a base member composed of a metal tube or a heat-resistant plastic tube, or a base member composed of a metal tube or a heat-resistant plastic tube coated with an elastic layer.

6. The heating fixing roller according to claim 1, wherein the tubular base member is a base member composed of a polyimide tube or a base member composed of a polyimide tube coated with an elastic layer.

7. A process for producing a heating fixing roller comprising the steps of applying a fluororesin dispersion containing an aqueous dispersion of phosphorus-doped tin oxide onto a tubular base member or an adhesive layer disposed on an outer circumferential surface of the tubular base member, and then sintering the fluororesin.

* * * * *